US006874171B2

(12) United States Patent
Erves

(10) Patent No.: US 6,874,171 B2
(45) Date of Patent: Apr. 5, 2005

(54) OVERSPRAY SHIELD FOR TOILET

(76) Inventor: Deanna Erves, 2860 Exeter Pl., Lithia Springs, GA (US) 30122

( * ) Notice: Subject to any disclaimer, the term of this patent is extended or adjusted under 35 U.S.C. 154(b) by 0 days.

(21) Appl. No.: 10/443,479

(22) Filed: May 22, 2003

(65) Prior Publication Data

US 2004/0231037 A1 Nov. 25, 2004

(51) Int. Cl.[7] ..... E03D 9/00
(52) U.S. Cl. ..... 4/300.3
(58) Field of Search ..... 4/300.3, DIG. 5

(56) References Cited

U.S. PATENT DOCUMENTS

| | | | | | |
|---|---|---|---|---|---|
| 3,914,803 | A | | 10/1975 | Gregovski | |
| 4,133,062 | A | | 1/1979 | Fulbright, Jr. | |
| 4,348,776 | A | | 9/1982 | Sarjeant | |
| 4,912,784 | A | * | 4/1990 | Jacobson et al. | 4/300.3 |
| 5,067,185 | A | | 11/1991 | Kohler | |
| 5,088,132 | A | | 2/1992 | Walka | |
| 5,117,512 | A | | 6/1992 | Bressler | |
| 5,216,760 | A | | 6/1993 | Brown et al. | |
| 5,276,925 | A | | 1/1994 | Blaha | |
| 5,373,589 | A | * | 12/1994 | Rego et al. | 4/300.3 |
| 5,564,135 | A | | 10/1996 | Jones et al. | |
| 5,625,905 | A | | 5/1997 | Woods | |
| D394,900 | S | | 6/1998 | Kang | |
| 6,032,302 | A | | 3/2000 | Eckert | |
| 6,052,840 | A | | 4/2000 | West et al. | |
| 6,119,282 | A | * | 9/2000 | Serbin | 4/300.3 |
| 6,357,055 | B1 | | 3/2002 | Gambla et al. | |
| 6,385,785 | B1 | | 5/2002 | Linden | |
| 6,550,075 | B1 | * | 4/2003 | Brannon, III | 4/300.3 |

* cited by examiner

*Primary Examiner*—Charles E. Phillips
(74) *Attorney, Agent, or Firm*—Myers Kaplan, LLC; Thomas R. Williamson, III

(57) ABSTRACT

A disposable urinal device and method suitable for installation on a toilet preventing overspray of urine and for containing said urine within the confines of the toilet. Said device comprises a frame having top and bottom portions attaching respectively to the toilet seat and the toilet bowl and an attachable sheet of material. The sheet attaches to said frame and may be readily removed therefrom for disposal.

9 Claims, 5 Drawing Sheets

OVERSPRAY SHIELD FOR TOILET

TECHNICAL FIELD

The present invention relates generally to an apparatus and method for use in protecting a toilet and surrounding area from urination overspray and more particularly to a disposable urinal-forming overspray shield capable of rapid installation on an existing toilet.

BACKGROUND OF THE INVENTION

The present invention began out of a need for a device that can readily be mounted on a toilet to provide protection against urination overspray, and which can be disposed of after use, or after brief periods of application.

Young boys and often, older men, on occasion have difficulty with maintaining their urination stream within the confines of a toilet. As a result, unforeseen consequences result for the toilet owner and/or the next user. Therefore, it is desirable to have an apparatus that can be readily installed upon an existing toilet, such that the device will function similarly to a standard urinal, while at the same time protecting the toilet and its surroundings from oversprayed urine.

Many such toilet shielding devices and methods have been designed in an attempt to prevent urine overspray, but all are disadvantageously difficult to clean and thus potentially non-hygienic when compared to the present invention.

Some previously described shields attach to a toilet to become substantially fixed devices. These designs necessitate the removal thereof for cleaning and thus complicate the ease and effectiveness of such cleaning.

Other shield-type devices are disadvantageously designed to direct urine overspray to the floor and/or to limit the target area for urine collection into the toilet. Still others protect only the seat, fail to adequately collect overspray and/or fail to protect the surrounding toilet area.

U.S. Pat. No. 3,914,803 to Gregovski teaches a splash shield of a formed panel that fastens to a toilet and which is attached to the lid so that it forms a shield when the lid is raised. Gregovski '803 is disadvantageous in being a fixed device incapable of being quickly removed or replaced. It must be cleaned in place or removed for cleaning.

U.S. Pat. No. 4,133,062 to Fulbright, Jr. teaches a device for lifting a toilet seat to form a urinal with accordion sides attached to the seat. Fulbright, Jr. '062 is permanently mounted to the toilet and suffers the disadvantage of having to be cleaned in place or removed for cleaning.

U.S. Pat. No. 4,348,776 to Sarjeant teaches a similar splashguard to that of Fulbright, Jr. '062 wherein a urinal is formed by raising the seat to which a set of nested telescopic plate segments is attached. Sarjeant '776 suffers from the same disadvantages as Fulbright, Jr. '062, namely that it must be removed for cleaning or cleaned in place since it is permanently affixed to the toilet apparatus.

U.S. Pat. No. 5,067,185 to Kohler teaches a toilet bowl protector that covers the bowl base and surrounding floor. While Kohler '185 protects the floor and toilet itself, it suffers the disadvantage of providing no side or back areas to form a urinal and must also be cleaned either in place or after removal.

U.S. Pat. No. 5,088,132 to Walka teaches a rigid folded absorbent shield that is placed on the floor behind the toilet bowl. Walka '132 is highly disadvantageous in that any overspray reaching it would then be deposited on the floor. It further fails to protect the toilet apparatus from overspray.

U.S. Pat. No. 5,117,512 to Bressler teaches a semicircular fixed spray shield that sits on the edge of a toilet bowl. Bressler '512 sits within the opening of the toilet and disadvantageously provides a small target opening and further is not a disposable device.

U.S. Pat. No. 5,216,760 to Brown et al. teaches an overspray shield of slightly conical shape that protects the toilet seat. It is adhesively attached. While Brown et al. '760 is removable, it is rigidly formed and not a disposable unit and thus is disadvantageous.

U.S. Pat. No. 5,276,925 to Blaha teaches an expanding conical tube urination aid that extends upward from the toilet opening toward the user. Blaha '925 is a fixed device that disadvantageously must be cleaned in place and provides a small target opening.

U.S. Pat. No. 5,564,135 to Jones et al. teaches a toilet bowl splashguard secured to the lower surface of a toilet seat such that it forms a generally U-shaped splash shield. It opens and collapses in accordion fashion through a set of lever arms that raise it as the seat is raised. Jones et al. '135 is permanently affixed to the toilet and seat, is overcomplicated, and must be disadvantageously cleaned in place or removed for cleaning.

U.S. Pat. No. 5,625,905 to Woods teaches a urine deflector that covers the toilet seat. Woods '905 disadvantageously protects only the seat and does not provide a urinal-shaped area and thus cannot contain overspray.

U.S. Design Pat. No. D394,900 to Kang teaches a splash shield that apparently mounts to the toilet bowl and is generally semicircular. Similar to Bressler '512, Kang '900 is depicted as a rigid device that disadvantageously would require cleaning.

U.S. Pat. No. 6,032,302 to Eckert teaches hinged interleaved segments that raise to a general conical shape when seat is raised. Eckert '302, permanently attached, disadvantageously is overly complex, does not form a urinal back, and thus cannot contain overspray. In addition, it requires cleaning in place or removal for cleaning.

U.S. Pat. No. 6,052,840 to West et al. teaches a toilet training accessory that rests on the toilet bowl and is a general shield with backsplash. It would of necessity be formed of rigid material. West et al. '840 provides a modicum of back area, but disadvantageously is not large enough to contain overspray. While not fixed in place, it disadvantageously is rigidly formed, non-disposable and requires cleaning.

U.S. Pat. No. 6,357,055 to Gambia et al. teaches a rigid semicircular splash shield with handle and means to fasten to toilet seat once seat is raised. Gambia et al. '055 forms a urinal-like back, but disadvantageously sits within the toilet opening and is thus small. While not permanently affixed, it is rigidly formed, non-disposable and must be cleaned.

U.S. Pat. No. 6,385,785 to Linden teaches a rigid semicircular splash shield that attaches to a raised toilet seat with a U-shaped hook. Linden '785 disadvantageously sits within the toilet opening and thus cannot contain side sprays. Further, thought not permanently affixed, it must still be cleaned.

While some or all of the above-referenced patents may well be utilized for shielding toilets from overspray, they fail to adequately provide a disposable urinal that can fully contain overspray, and they are overly complicated.

Therefore, it is readily apparent that there is a need for an overspray device, wherein a disposable urinal is effectively created thereby, thus eliminating or minimizing the need for cleaning thereof and avoiding the above-discussed disadvantages.

BRIEF SUMMARY OF THE INVENTION

Briefly described, in a preferred embodiment, the present invention overcomes the above-mentioned disadvantages and meets the recognized need for a disposable toilet overspray device by providing a method and apparatus for creating a urinal overspray device that allows single-use replacement thereof.

According to its major aspects and broadly stated, the present invention in its preferred embodiment is a disposable urinal and toilet overspray collection device.

More specifically, the present invention is a frame for supporting a disposable sheet, wherein the frame can be quickly and temporarily installed on any known toilet apparatus and wherein a soiled sheet may be disposed of without cleaning and a replacement sheet installed in its place, thus obviating the need for cleaning.

A feature and advantage of the present invention is its ability to provide a device that collects urine via a shape similar to a urinal and that can be installed quickly over an existing toilet.

A further feature and advantage of the present invention is that it is disposable, does not require cleaning and is thus hygienic.

A feature and advantage of the present invention is that it prevents overspray laterally, as well as in the direction of the urine stream.

A further feature and advantage of the present invention is that it utilizes low cost, disposable materials.

An additional feature and advantage of the present invention is that flushable materials may be utilized.

A further feature and advantage of the present invention is that it is relatively easy to fabricate.

A feature and advantage of the present invention is its inherent portability and transportability.

An additional feature and advantage of the present invention is that it can be installed either temporarily or permanently.

These and other objects, features and advantages of the present invention will become more apparent to one skilled in the art from the following description and claims when read in light of the accompanying drawings.

BRIEF DESCRIPTION OF THE DRAWINGS

Figure 1:
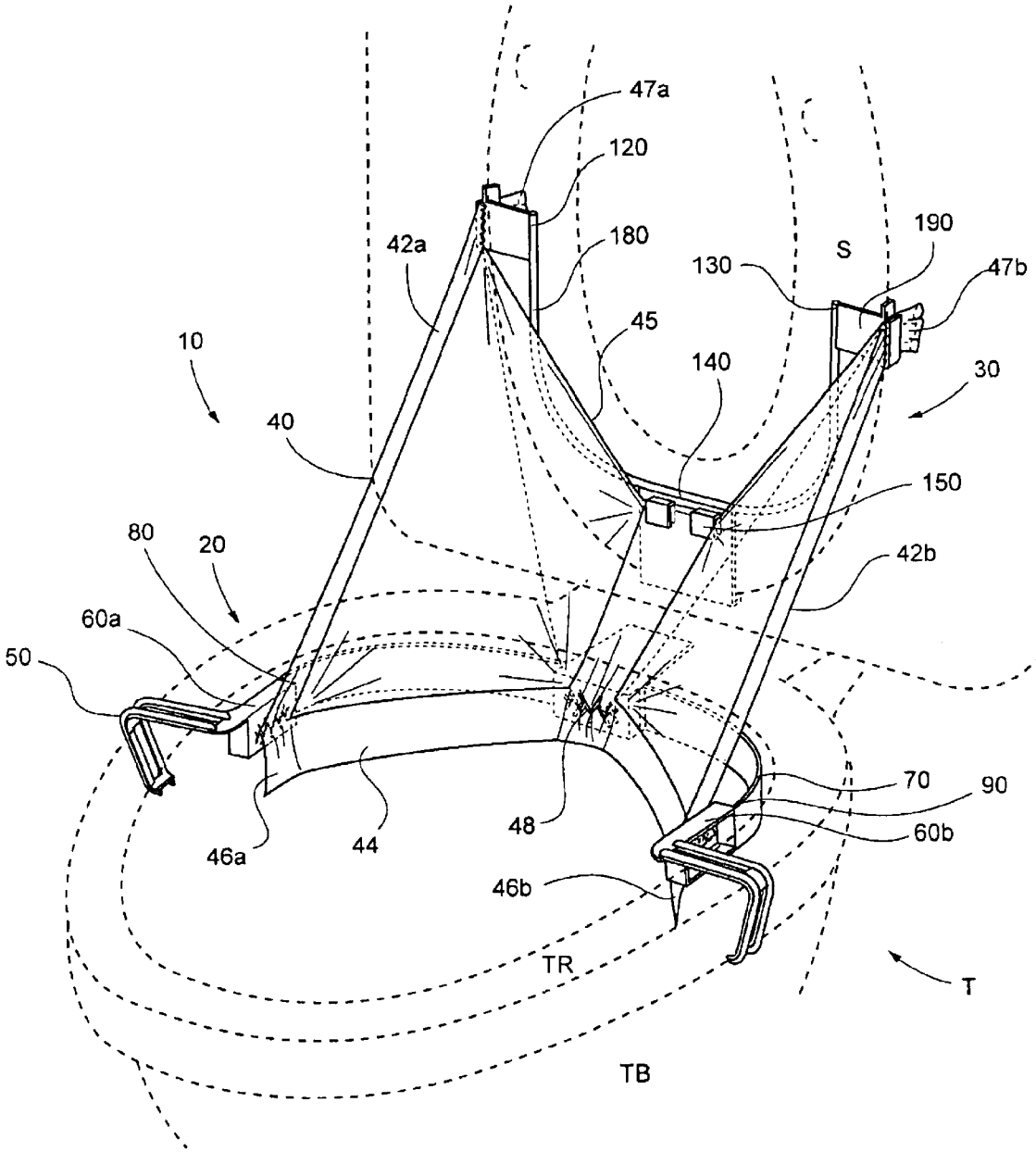
Figure 2:
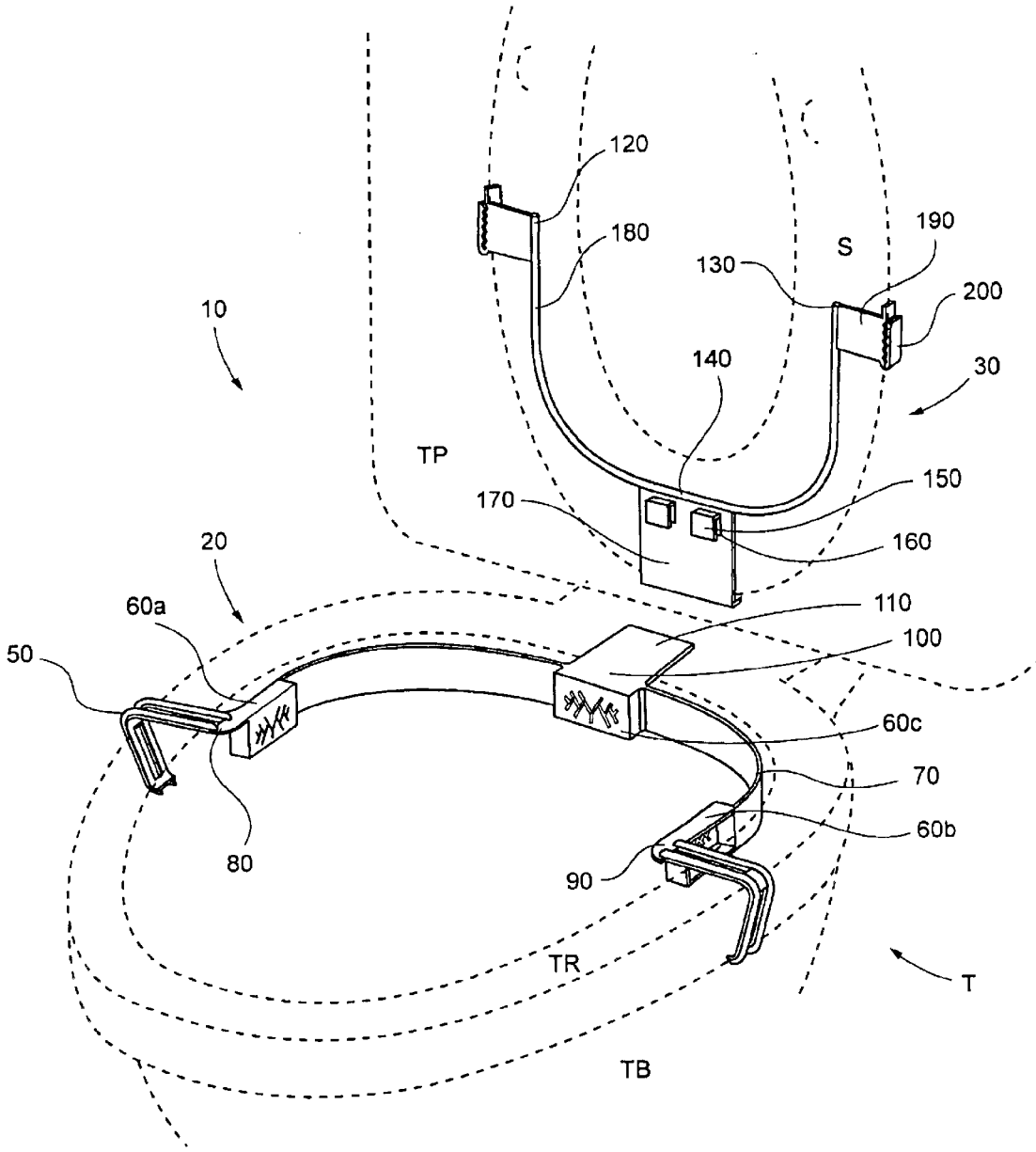
Figure 3A:
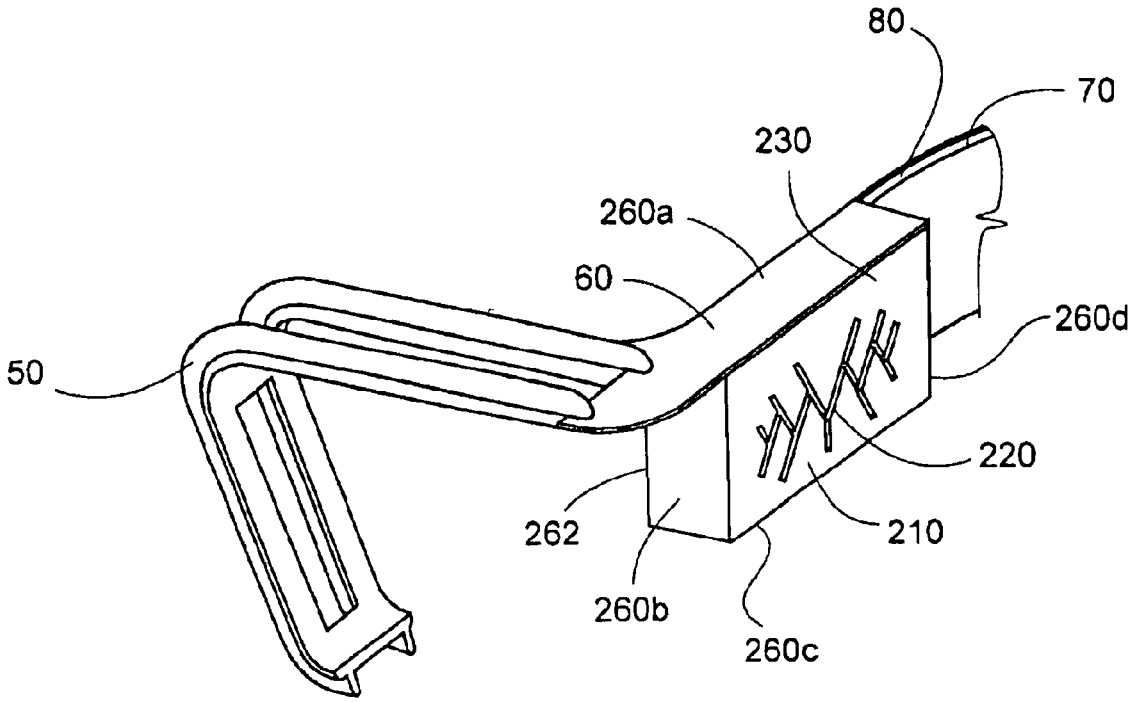
Figure 3B:
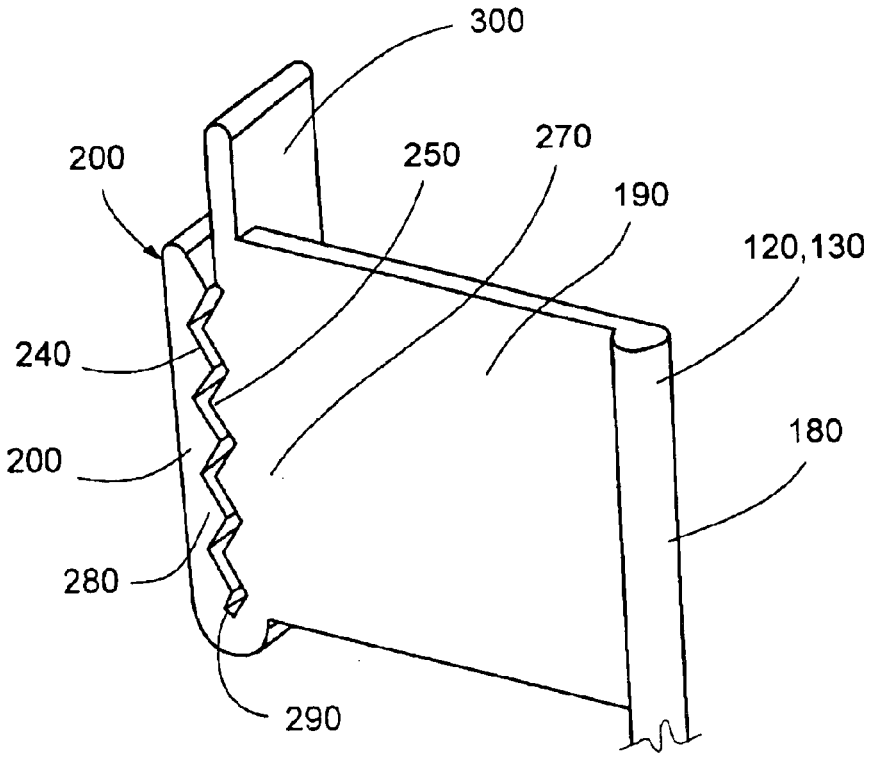
Figure 4:
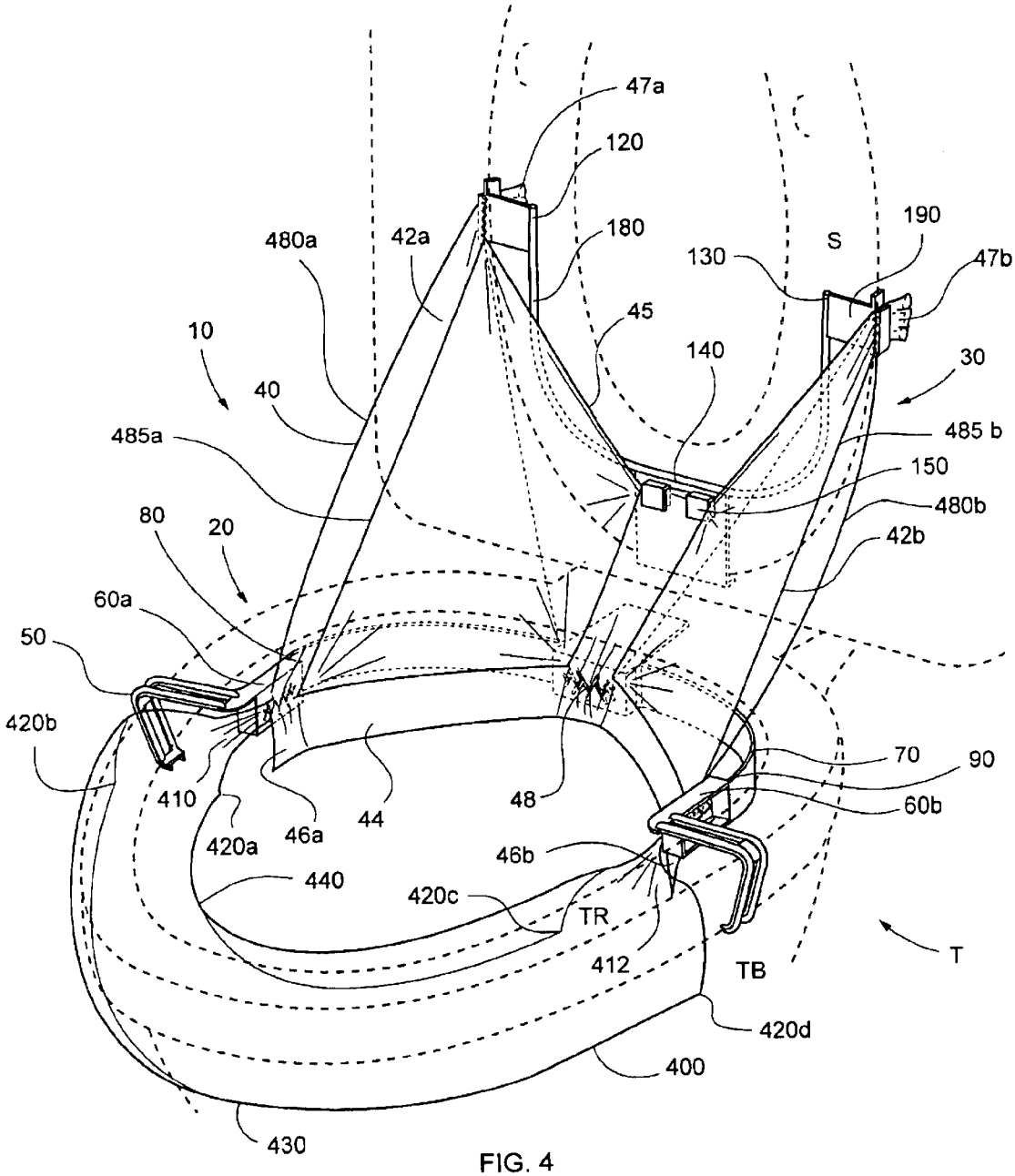
Figure 5:
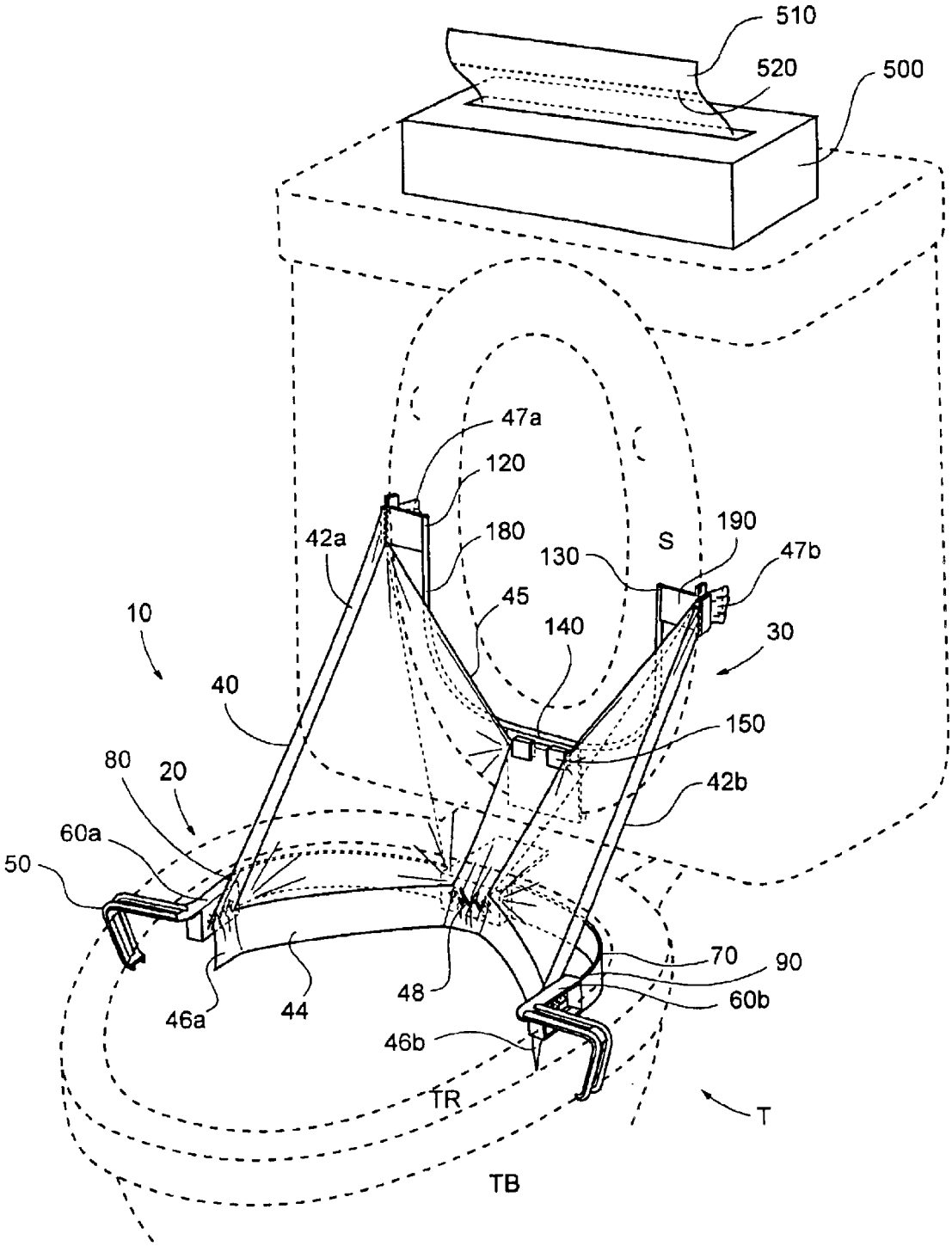

Having thus described the invention in general terms, the present invention will be better understood by reading the Detailed Description of the Preferred and Alternate Embodiments with reference to the accompanying drawing figures, which are not necessarily drawn to scale, and in which like reference numerals denote similar structures and refer to like elements throughout, and in which:

FIG. 1 is a perspective view of a disposable overspray protection device according to a preferred embodiment of the present invention;

FIG. 2 is a perspective view of the supporting frame of the device of FIG. 1, according to a preferred embodiment of the present invention;

FIG. 3A is a perspective view of an insertion retaining device of the frame of FIG. 2, according to a preferred embodiment of the present invention;

FIG. 3B is a perspective view of a bobbie-pin style holding clip component of the frame of FIG. 2, according to a preferred embodiment of the present invention;

FIG. 4 is a perspective view of a disposable overspray protection device according to an alternate embodiment of the present invention; and FIG. 5 is a perspective view of a disposable overspray protection device according to an alternate embodiment of the present invention, shown with an automatic dispenser.

DETAILED DESCRIPTION OF THE PREFERRED AND ALTERNATIVE EMBODIMENTS

In describing the preferred and selected alternate embodiments of the present invention, as illustrated in the Figures, specific terminology is employed for the sake of clarity. The invention, however, is not intended to be limited to the specific terminology so selected, and it is to be understood that each specific element includes all technical equivalents that operate in a similar manner to accomplish similar functions.

The present invention is suitable for use on toilet apparatus, as are known in the art, and enables the incorporation of a urinal-type collector therein. The urine collection barrier of the present invention serves to contain urine overspray in both the direction of the urine stream and lateral to the stream.

Referring now to FIG. 1, apparatus 10, for installation on toilet T, is a portable, urinal device preferably having base frame 20, seat frame 30 and sheet 40.

Referring to FIGS. 1 and 2, base frame 20 preferably rests on toilet base TB. Base frame 20 preferably has legs 50 extending over the peripheral edge of toilet rim TR of toilet base TB and preferably bending down thereover to form a snap fit on the edge of toilet base TB, thus resiliently and removably retaining base frame 20 to toilet base TB. Base frame, or first attachment means, 20 preferably has a plurality of insertion fasteners 60 located on frame band 70. Frame band 70 preferably has first end 80, second end 90 and middle portion 100. At least one of a plurality of insertion fasteners 60 is preferably located at first end 80, second end 90 and middle portion 100. Legs 50 are preferably located proximate to insertion fasteners 60*a* and 60*b*, proximate first end 80 and second end 90, respectively, of frame band 70. Preferably located at middle portion 100 is support flange 110, proximate insertion fastener 60*c*. Support flange 110 serves to hold base frame 20 on the top of toilet rim TR.

Seat frame, or second attachment means, 30 preferably has first end 120, second end 130 and middle portion 140. Located proximate middle portion 140 is support flange 170, wherein at least one sheet anchor 150 is provided thereon; preferably two sheet anchors 150 are provided on supporting flange 170, but one skilled in the art would readily recognize that any number of sheet anchors could be utilized. Preferably, each sheet anchor 150 has a sheet receptacle 160 defined therein, wherein sheet receptacle 160, in a preferred configuration, defines an open groove for receiving sheet 40 therein. Sheet receptacle 160 is preferably defined in sheet anchor 150 wherein open groove of sheet receptacle 160 is directed downward in the direction of the floor when lid S is open, and is directed in the direction of the tank when lid S is closed. Preferably, support flange 170 extends from seat frame 30 to base hinge edge of seat S, wherein support flange 170 preferably extends past the base hinge edge of seat S and thereby prevents movement of support flange 170.

Side arms 180 of seat frame 30 are preferably disposed laterally to middle portion 140, preferably extending along seat S in close proximity thereto. Retainer supports 190 are preferably located proximate first end 120 and second end 130 of seat frame 30, wherein retainer supports 190 are generally L-shaped members facilitating placement of seat frame 30 on seat S. Bobbie-pin-shaped retention fasteners 200 are preferably defined in each retainer support 190 such that retention fasteners 200 are located proximal to the tank portion TP of toilet T and to the opposing outer edges of seat S, when apparatus 10 is installed on a toilet and seat S is in the raised position.

Two corners, 46*a* and 46*b*, of sheet 40 are preferably removably held within insertion fasteners 60*a* and 60*b*, respectively, to enable utilization of apparatus 10. Center portion 48 of sheet 40 is preferably removably held within insertion fastener 60*c* located on middle portion 100 of seat frame 30, whereupon two corners 46*a* and 46*b* and center portion 48 of sheet 40 are preferably mounted, a generally triangular or U-shaped edge being defined thereby at the base edge 44 thereof. Upper edge 45 of sheet 40 is preferably removably held within the outer peripheral edge of the toilet seat S, wherein upper edge 45 of sheet 40 is positioned proximate to the front of tank portion TP. Upper edge 45 of sheet 40 is preferably retained by sheet receptacles 160 defined in sheet anchors 150. Preferably corners 47*a* and 4T*b* are held via moderate tension within bobbie-pin-shaped retention fasteners 200 of support flanges 190. Preferred position of sheet 40 effectively creates a urinal-type apparatus superimposed on toilet T.

Preferably, base portion 44 of sheet 40 hangs from insertion fasteners 60*a*, 60*b* and 60*c* and therebetween, extending below toilet rim TR to facilitate transfer of collected urine into toilet bowl TB. A first and second lateral portion 42*a* and 42*b*, respectively, of sheet 40 preferably extend from each insertion fastener 60*a* and 60*b* to bobbie-in-shaped retention fasteners 200, to form a deflecting sidewall, thus providing additional lateral protection against overspray.

Sheet 40 may be constructed of any suitable material, such as, for exemplary purposes only, thin plastic film or sheeting, paper, or metal foil. It should be recognized that sheet 40 preferably may be constructed of any material that would be disposable and non-rigid or semi-rigid, including any alternate lightweight materials, and as such, would be in full contemplation of the inventor in describing the present invention herein, and could be utilized without departing from the appreciative scope of the present invention. Further, sheet 40 may be made from a material suitable for flushing in toilet T.

Referring to FIG. 3A, insertion fastener 60 is positioned proximate to first end 80 of frame band 70, wherein insertion fastener 60 preferably has four sides 260*a*, 260*b*, 260*c*, and 260*d*, and front face 230. Sides 260*a*, 260*b*, 260*c*, and 260*d*, and front face 230 preferably define a generally rectangular-faced box having five faces, and which preferably remains open on the sixth face 262. Front face 230 preferably has teeth 210 formed therein, wherein teeth 210 are preferably separated by spaces 220. Referring to FIG. 1, in use, sheet 40 preferably has a portion of corners 46*a* and 46*b* secured between teeth 210 within spaces 220. Each corner, 46*a* and 46*b*, of sheet 40 is accessible and preferably may be pulled from behind front face 230 to provide moderate tension adjustment. Center portion 46*c* is preferably installed in similar fashion into insertion fastener 60*c* located at middle portion 140.

Front face 230 is preferably made of a material suitable to provide strength and minimal flexure in order to facilitate gripping of sheet 40 by teeth 210.

Referring now to FIG. 3B, support flange 190 has ridges 250 preferably at extremity 270 thereof, wherein ridges 250 preferably mate with opposing teeth 240 of a bobbie-pin-shaped retention fastener 200. Ridges 250 are preferably juxtaposed to teeth 240, and in close proximity thereto, in order to facilitate gripping of sheet 40 when positioned thereinto.

Grip flange 300 preferably aides in positioning sheet 40 within bobbie-pin-shaped retention fasteners 200 by preferably providing a purchase by which arm 280 may be opened slightly for insertion of sheet 40 between ridges 250 and teeth 240.

Sheet 40 is retained by preferably pulling a portion thereof into bobbie-pin-shaped retention fasteners 200, such that sheet 40 preferably resides in spaces 290 between teeth 240 and ridges 250. Bobbie-pin-shaped retention fasteners 200 are preferably rigidly, yet resiliently formed such that they have a spring-back effect to provide clamping compression force by teeth 240 against ridges 250.

Base frame 20, seat frame 30, insertion fasteners 60 and bobbie-pin-shaped fasteners 200 are preferably comprised of suitable material, such as, for exemplary purposes only, plastic, wood and/or metal, preferably sufficiently rigid to maintain the form of base frame 20 and seat frame 30, while sufficiently flexible to allow insertion of sheet 40 and sufficiently resilient to enable return to their original position to retain sheet 40 firmly.

FIG. 4 shows an alternative embodiment of the present invention wherein there is second sheet 400 made from the same or similar material as sheet 40, wherein second sheet 400 is located proximate toilet rim TR, on the top portion thereof, and extends around the front arc thereof. Second sheet 400 has first end 410 inserted within insertion fastener 60*a* and held thereby, such that first corner 420*a* hangs downward within toilet bowl TB. Sheet 400 extends over toilet rim TR and extends in front thereof, such that second corner 420*b* hangs outside of toilet bowl TB. Thus, sheet 400 substantially covers toilet rim TR and extends in front thereof. Second end 412 of sheet 400 is installed within insertion fastener 60*b* and held thereby. Third corner 420*c* of sheet 400 hangs downward within toilet bowl TB. Fourth corner 420*d* of sheet 400 hangs downward outside of toilet bowl TB. By positioning sheet 400 in such a fashion, front edge 430 of sheet 400 extends over and down the outside of toilet rim TR, while rear edge 440 of sheet 400 hangs within toilet bowl TB.

It is envisioned in an alternative embodiment that the sheet 40 may be adhesively attached to base frame 20 and seat frame 30, such as by, for exemplary purposes only, double-sided adhesive tape or hook-and-loop fastener.

It is also envisioned that the present invention may be implemented using a single style of clip, such as, for exemplary purposes only, insertion fasteners or bobbie-pin-shaped retention apertures.

It is contemplated in an alternative embodiment best shown in FIG. 4, that sheet 40 could be generally circular or oval-shaped, with ballooning edges 480*a* and 480*b*, that is, with rounded edges, such that edges 480*a* and 480*b* could extend outwardly beyond the general straight line between sheet attachment points, namely, retention apertures 200 and insertion fasteners 60*a*, 60*b*, and wherein said sheet may be rigid or flexible.

It is envisioned in an alternative embodiment that base frame or seat frame could have only one insertion fastener and/or only one bobbie-pin-shaped retention fastener 200.

It is envisioned in yet another embodiment that there may be any number of insertion fasteners and/or bobbie-pin style fasteners 200.

In a further embodiment, it is contemplated that the insertion fasteners 60 and bobbie-pin-shaped retention fasteners 200 may be discrete and utilized without a frame, thus permitting independently variable placement on a toilet bowl and/or seat, wherein each could be pressure fit or adhesively held.

It is contemplated that the present invention may be sized and shaped to fit any size or style of toilet.

It is contemplated that an additional embodiment would have frames suitable for mounting between the top of toilet seat S and toilet tank when toilet seat S is in the lowered position.

In an alternative embodiment, hook-and-loop fasteners may be used to attach the base frame 20 and seat frame 30 to the toilet components.

In a further embodiment, the sheet 40 may be directly attached to the toilet components using an attachment means, such as, for exemplary purposes only, adhesive means.

It is further contemplated in the additional embodiment of FIG. 5, that sheet material 510 may be fed from automatic dispenser 500, and may have lines for separation 520 formed therein, such as, for exemplary purposes only, perforations, whereby the sheets may be torn off and immediately disposed of within the toilet.

Having thus described exemplary embodiments of the present invention, it should be noted by those skilled in the art that the within disclosures are exemplary only, and that various other alternatives, adaptations, and modifications may be made within the scope of the present invention. Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation. Accordingly, the present invention is not limited to the specific embodiments illustrated herein, but is limited only by the following claims.

What is claimed is:

1. A urine collection barrier for use with a toilet, having a toilet bowl and a toilet seat, said urine collection barrier comprising:

at least one sheet of material;

a first frame and a second frame, wherein said first frame and said second frame further comprise at least one tension-type fastener for retaining said at least one sheet of material;

a first attachment means, said first attachment means carried by the toilet bowl; and a second attachment means carried by the toilet seat, wherein said at least one sheet is removably attached to the toilet seat and toilet bowl via respective attachment means employing tension-type fasteners for retaining said at least one sheet of material in an orientation so as to function as a urine collection barrier between the seat and the bowl.

2. The urinal device of claim 1, wherein said first attachment means and said second attachment means are secured to the toilet bowl and to the toilet seat by adhesive means.

3. The urinal device of claim 2, wherein said adhesive means is double-sided tape.

4. The urinal device of claim 1, wherein said first attachment means and said second attachment means are secured to the toilet bowl and the toilet seat by hook-and-loop fasteners.

5. The urinal device of claim 1, wherein said at least one sheet is made of a flexible material.

6. The urinal device of claim 1, wherein said at least one sheet is made of a biodegradable material suitable for flushing down a toilet.

7. The urinal device of claim 1, wherein said at least one sheet comprises a material selected from the group consisting of paper, plastic and metal.

8. The urinal device of claim 1, wherein said first frame and said second frame comprise a material selected from the group consisting of wood, plastic and metal.

9. The urinal device of claim 1, wherein said at least one tension-type fastener comprises a generally planar surface, said generally planar surface having an aperture with gripping teeth defined therein.

* * * * *